US008557494B2

(12) United States Patent
Ikami

(10) Patent No.: US 8,557,494 B2
(45) Date of Patent: Oct. 15, 2013

(54) TONER BLOCK

(75) Inventor: Jun Ikami, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 97 days.

(21) Appl. No.: 13/220,734

(22) Filed: Aug. 30, 2011

(65) Prior Publication Data

US 2012/0082929 A1 Apr. 5, 2012

(30) Foreign Application Priority Data

Sep. 30, 2010 (JP) ..... 2010-220842
Sep. 30, 2010 (JP) ..... 2010-220843

(51) Int. Cl.
*G03G 9/08* (2006.01)

(52) U.S. Cl.
USPC ..... 430/110.1

(58) Field of Classification Search
USPC ..... 430/110.1
See application file for complete search history.

(56) References Cited

U.S. PATENT DOCUMENTS

| | | | | |
|---|---|---|---|---|
| 7,135,265 | B2 | 11/2006 | Teshima | |
| 7,611,816 | B2 | 11/2009 | Tsuji | |
| 2003/0148202 | A1 * | 8/2003 | Matsumura et al. | 430/108.1 |
| 2004/0048183 | A1 | 3/2004 | Teshima | |
| 2004/0134560 | A1 | 7/2004 | Sato et al. | |
| 2005/0238986 | A1 * | 10/2005 | Itoh | 430/110.2 |
| 2005/0287464 | A1 * | 12/2005 | Cheng et al. | 430/124 |
| 2006/0063082 | A1 * | 3/2006 | Mikuriya et al. | 430/108.3 |
| 2008/0241730 | A1 | 10/2008 | Tuji et al. | |
| 2009/0123186 | A1 * | 5/2009 | Sugiura et al. | 399/223 |
| 2009/0191477 | A1 * | 7/2009 | Kawamura et al. | 430/137.15 |
| 2009/0214974 | A1 * | 8/2009 | Kouyama et al. | 430/108.21 |
| 2009/0226840 | A1 | 9/2009 | Fumita | |

FOREIGN PATENT DOCUMENTS

| | | | |
|---|---|---|---|
| CN | 1469202 A | | 1/2004 |
| CN | 1916774 A | | 2/2007 |
| JP | 58095355 | * | 6/1983 |
| JP | 60-021055 | | 2/1985 |
| JP | 62238577 | * | 10/1987 |
| JP | 01040951 | * | 2/1989 |
| JP | 05-040366 | | 2/1993 |
| JP | 07-181720 | | 7/1995 |
| JP | 08-305152 | | 11/1996 |
| JP | 09127778 | * | 5/1997 |
| JP | 2004-061757 | | 2/2004 |
| JP | 2007-058201 | | 3/2007 |
| JP | 2007-316488 A | | 12/2007 |
| JP | 4313300 B2 | | 8/2009 |

OTHER PUBLICATIONS

CN Office Action dtd Sep. 29, 2012 CN App 201110297069.1, English translation.
CN Office Action dtd Oct. 30, 2012, CN App 201110297129.X, English translation.
Second Office Action for Chinese Patent Application No. 201110297129.X dated Jul. 30, 2013 and English translation.

* cited by examiner

*Primary Examiner* — Hoa V Le
(74) *Attorney, Agent, or Firm* — Banner & Witcoff, Ltd.

(57) ABSTRACT

There is provided a toner block, which is formed by preparing a toner suspension in which toner particles are dispersed in water so that a water amount is 32.5 to 37% by mass; absorbing water contained in the toner suspension by a water absorptive material which absorbs 0.2 ml of water within 3 minutes to prepare an aggregate of the toner particles containing water of not more than 32.3% by mass; and drying the aggregate, and which has a maximum compressive stress of 80000 to 550000 N/m$^2$ upon collapse.

9 Claims, 4 Drawing Sheets

TONER BLOCK

CROSS REFERENCE TO RELATED APPLICATION

The present application claims priority from Japanese Patent Applications No. 2010-220842 filed on Sep. 30, 2010 and No. 2010-220843 filed on Sep. 30, 2010, the disclosure of which are incorporated herein by reference in its entirety.

BACKGROUND OF THE INVENTION

1. Field of the Invention

The present invention relates to a toner block which is usable, for example, for the electrophotographic method and the electrostatic recording method and which includes toner particles aggregated or assembled in order to form a visible image.

2. Description of the Related Art

A positively chargeable non-magnetic toner composed of one component has been hitherto known as the toner which is usable, for example, for the electrophotographic method and the electrostatic recording method. The toner as described above is a powder, which is used while being charged in a developing cartridge.

The following method has been suggested, for example, as a method for charging the toner in the developing cartridge. That is, a developing cartridge, which is provided with an accommodating chamber for accommodating a developer, is used, wherein a developer supply nozzle is inserted into a developer supply port of the accommodating chamber, and the developer is charged from the developer supply nozzle into the accommodating chamber while being pressurized (for example, see Japanese patent laid open No. 2004-61757).

However, in the case of the method described above, the toner, which is the powder, is charged while being pressurized. Therefore, the toner is scattered in some cases, for example, when the developer supply nozzle is removed from the developer supply port.

SUMMARY OF THE INVENTION

In view of the above, an object of the present invention is to provide a toner block which makes it possible to prevent a toner from being scattered.

According to an aspect of the present teaching, there is provided a toner block which includes an aggregate of toner particles, wherein the toner block has a maximum compressive stress of 80000 to 550000 N/m$^2$ upon collapse. Alternatively, the toner block may have a maximum compressive stress of 90000 to 500000 N/m$^2$ upon collapse.

The toner block of the present teaching may have a maximum shearing stress of 120 to 1800 N/m$^2$ upon collapse, alternatively, may have the maximum shearing stress of 150 to 1650 N/m$^2$ upon collapse.

The toner block of the present teaching may have a bulk density of 0.3 to 0.8 g/ml, alternatively, may have the bulk density of 0.45 to 0.7 g/ml.

The toner block of the present teaching may have a filling rate of 30 to 69%, alternatively, may have the filling rate of 39 to 65%.

According to the aspect of the present invention, the toner block is formed of an aggregate of the toner particles.

Therefore, when the toner block is introduced as it is into a developing cartridge, it is possible to prevent the toner particles from being scattered.

Further, the toner block is formed by mutually aggregating (coagulating) the toner particles relatively loosely to have the maximum compressive stress of 80000 to 550000 N/m$^2$ upon collapse, or 90000 to 500000 N/m$^2$ upon collapse.

Therefore, it is possible to provide a powder of the toner particles by easily unbinding the toner block in the developing cartridge.

Further, the toner block may be formed by mutually aggregating (coagulating) the toner particles relatively loosely to have the maximum shearing stress of 120 to 1800 N/m$^2$ upon collapse, or 150 to 1650 N/m$^2$ upon collapse.

In these cases, it is possible to provide a powder of the toner particles by easily unbinding the toner block in the developing cartridge.

Further, the bulk density of the toner block may be adjusted to 0.3 to 0.8 g/ml, or 0.45 to 0.7 g/ml.

In these cases, the toner block is formed by mutually aggregating (coagulating) the toner particles relatively loosely.

Further, the filling rate of the toner block may be adjusted to 30 to 69%, or 39 to 65%. In these cases as well, the toner block is formed by mutually aggregating (coagulating) the toner particles relatively loosely.

In any of the above cases, it is possible to provide a powder of the toner particles by easily unbinding the toner block in the developing cartridge.

BRIEF DESCRIPTION OF THE DRAWINGS

FIGS. 2A and 2B show schematic constructions to explain a compression test machine, wherein FIG. 2A shows the compression test machine when the maximum compressive stress is measured, and FIG. 2B shows the compression test machine when the maximum shearing stress is measured.

DESCRIPTION OF THE PREFERRED EMBODIMENTS

Figure 1:
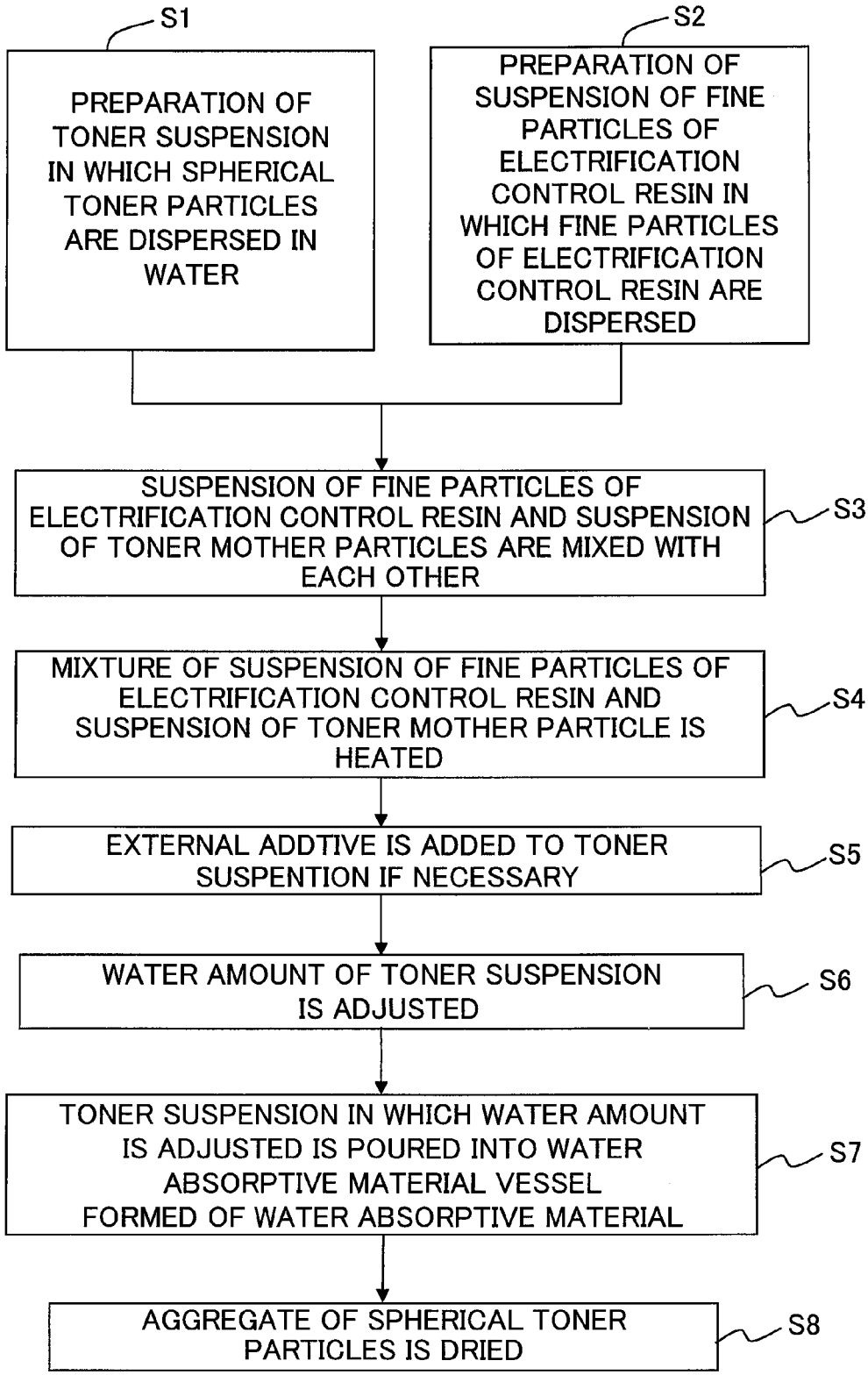
FIG. 1 is a flowchart showing a method for producing a toner block of the present invention.

Hereinbelow, an explanation will be made about a method for producing a toner block of the present teaching with reference to FIG. 1. The toner block is formed by aggregating or assembling spherical toner particles (spherical toners). In order to form the toner block, at first, a toner suspension, in which the spherical toner particles are dispersed in water, is prepared (51).

1. Preparation of Toner Suspension

<1> Preparation of Toner Mother Particle Suspension

In order to prepare the toner suspension, at first, a toner mother particle suspension, in which spherical toner mother particles are dispersed, is prepared.

<1-1> Preparation of Suspension of Mother Fine Particles

In order to prepare the suspension of the toner mother particles, at first, a mother fine particle suspension, in which mother fine particles containing a polyester resin, a coloring agent, and a wax are dispersed, is prepared.

<1-1-1> Polyester Resin

The polyester resin has a functional group having an acid value (for example, carboxyl group). The commercially available product is exemplified, for example, by ER508 (produced by Mitsubishi Rayon Co. Ltd.), FC1565 (produced by Mitsubishi Rayon Co. Ltd.), and FC023 (produced by Mitsubishi Rayon Co. Ltd.).

The acid value of the polyester resin is, for example, 0.5 to 40 mgKOH/g and preferably 1.0 to 20 mgKOH/g.

The weight average molecular weight of the polyester resin (based on the GPC measurement by using standard polystyrene for a calibration curve) is, for example, 9,000 to 200,000 and preferably 20,000 to 150,000.

The cross-linking part (THF insoluble part, gel part) of the polyester resin is, for example, not more than 10% by mass and preferably 0.5 to 10% by mass.

The glass transition temperature (Tg) of the polyester resin is, for example, 50 to 70° C. and preferably 55 to 65° C.

<1-1-2> Coloring Agent

The coloring agent colors the spherical toner particles by dispersing or permeating the coloring agent in/into the polyester resin. When the black spherical toner particles are obtained, for example, carbon black is used.

Those usable as the coloring agent include, for example, organic pigments such as Quinophthalone Yellow, Hansa Yellow, Isoindolinone Yellow, Benzidine Yellow, Penoline Orange, Perinone Red, Perylene Maroon, Rhodamine 6G Lake, Quinacridone Red, Rose Bengal, Copper Phthalocyanine Blue, Copper Phthalocyanine Green, diketopyrrolopyrrole-based pigments and the like; inorganic pigments or metal powders such as Titanium White, Titanium Yellow, Ultramarine, Cobalt Blue, Indian Red (colcothar), aluminum powder, bronze and the like; oil-soluble dyes or disperse dyes such as azo dyes, quinophthalone dyes, anthraquinone dyes, xanthene dyes, triphenylmethane dyes, phthalocyanine dyes, indophenol dyes, indoaniline dyes and the like; and rosin dyes such as rosin, rosin-modified phenol, rosin-modified maleic acid resin, and the like. Further, there are also exemplified dyes and pigments processed, for example, with higher fatty acid or resin. The coloring agents as described above can be used singly or they can be used in combination depending on the desired color. For example, the toner of a chromatic single color can be blended with the pigment and the dye based on the same color, for example, the pigment and the dye based on Rhodamine, the pigment and the dye based on Quinophthalone, and the pigment and the dye based on Phthalocyanine respectively.

The coloring agent is blended, for example, at a ratio of 2 to 20 parts by mass and preferably 4 to 10 parts by mass with respect to 100 parts by mass of the polyester resin.

<1-1-3> Wax

The wax is added in order to improve the fixing performance of the spherical toner particles with respect to a recording medium such as paper. The wax is exemplified, for example, by ester-based wax and hydrocarbon-based wax.

The ester-based wax includes, for example, aliphatic ester compounds such as stearic acid ester, palmitic acid ester and the like; and polyfunctional ester compounds such as pentaerythritol tetramyristate, pentaerythritol tetrapalmitate, dipentaerythritol hexapalmitate and the like.

The hydrocarbon-based wax includes, for example, polyolefin waxes such as low molecular weight polyethylene, low molecular weight polypropylene, low molecular weight polybutylene and the like; plant-based natural waxes such as candelilla, carnauba, rice, Japan tallow or Japan wax, jojoba and the like; petroleum-based waxes and modified waxes thereof such as paraffin-based wax, microcrystalline, petrolatum and the like; and synthetic waxes such as Fischer-Tropsch wax and the like.

The waxes as described above can be used singly or they can be used in combination, and the wax is preferably exemplified by the ester-based wax.

The wax is blended at a ratio of, for example, 1 to 20 parts by mass and preferably 3 to 10 parts by mass with respect to 100 parts by mass of the polyester resin.

<1-1-4> Preparation of Polyester Resin Emulsion

In order to prepare the suspension of the mother fine particles, at first, a polyester resin liquid (oil phase), which contains the polyester resin, the coloring agent, and the wax, is mixed with a water base medium or aqueous medium (water phase) which contains water to prepare a polyester resin emulsion in which the polyester resin liquid is dispersed in the water base medium.

In order to prepare the polyester resin liquid, at first, the coloring agent is dispersed in an organic solvent to prepare a coloring agent dispersion. After that, the coloring agent dispersion, the polyester resin, the wax, and the organic solvent are blended.

The organic solvent is not specifically limited provided that the polyester resin and the wax can be dissolved or swelled. The organic solvent is exemplified, for example, by ethyl acetate, methyl ethyl ketone (MEK), tetrahydrofuran (THF), and acetone. The organic solvents as described above can be used singly or they can be used in combination.

In order to prepare the coloring agent dispersion, the polyester resin is blended at a blending ratio of, for example, 50 to 200 parts by mass and preferably 80 to 150 parts by mass and the organic solvent is blended at a blending ratio of, for example, 1000 to 3500 parts by mass and preferably 900 to 3600 parts by mass with respect to 100 parts by mass of the coloring agent, followed by being stirred (agitated) and mixed with each other by means of a stirrer or agitator (for example, disper or homogenizer).

In order to prepare the polyester resin liquid, the polyester resin is blended at a blending ratio of, for example, 100 to 500 parts by mass and preferably 200 to 300 parts by mass, the wax is blended at a blending ratio of, for example, 5 to 35 parts by mass and preferably 10 to 30 parts by mass, and the organic solvent is blended at a blending ratio of, for example, 500 to 2000 parts by mass and preferably 800 to 1500 parts by mass with respect to 100 parts by mass of the coloring agent dispersion, followed by being mixed with each other.

After that, the heating is performed to such a heating temperature that the heating temperature is not less than a temperature at which the wax is soluble and the heating temperature is less than the boiling point of the organic solvent, specifically the heating temperature being a temperature which exceeds, for example, 30° C. and preferably the heating temperature being 32 to 79° C. depending on the types of the wax and the organic solvent so that the wax is dissolved in the organic solvent, and thus the polyester resin liquid is obtained.

Subsequently, in order to prepare the polyester resin emulsion, the water base medium is prepared distinctly such that water is blended with an organic base aqueous solution obtained, for example, by dissolving a basic organic compound such as an amine compound or the like in water and/or an inorganic base aqueous solution obtained, for example, by dissolving an alkali metal such as potassium hydroxide or the like in water or an aqueous sodium hydroxide solution.

When the inorganic base aqueous solution is blended, the inorganic base aqueous solution of, for example, 0.1 to 5 N (normal) preferably 0.2 to 2 N (normal) is blended at a blending ratio of, for example, 0.1 to 40 parts by mass preferably 1 to 20 parts by mass with respect to 100 parts by mass of water.

When the organic base aqueous solution is blended, the organic base aqueous solution of, for example, 0.1 to 5 N (normal) preferably 0.2 to 2 N (normal) is blended at a blending ratio of, for example, 0.5 to 20 parts by mass preferably 1 to 10 parts by mass with respect to 100 parts by mass of water.

A water-soluble solvent (for example, alcohols and glycols), an additive (for example, a surfactant and a dispersing agent) can be appropriately blended with the water base medium as well.

Subsequently, in order to prepare the polyester resin emulsion, for example, the polyester resin liquid is blended at a blending ratio of 50 to 150 parts by mass and preferably 80 to 120 parts by mass with respect to 100 parts by mass of the water base medium, followed by being mixed with each other.

In particular, when the wax is contained in the polyester resin liquid, the polyester resin liquid and the water base medium are heated within such a temperature range that the temperature is not less than a temperature at which the wax is soluble and the temperature is less than a boiling point of the organic solvent, for example, 30 to 80° C., preferably 40 to 70° C. The polyester resin liquid and the water base medium are blended while maintaining the heating temperature.

After that, the mixing is performed by using, for example, a high speed dispersing machine such as a homogenizer (rotor stator type) or the like, while maintaining the heating temperature.

The number of revolutions of the homogenizer is adjusted so that the tip peripheral speed is, for example, 5 to 20 m/s and preferably 7 to 14 m/s. The stirring time is, for example, 10 to 120 minutes and preferably 15 to 60 minutes.

Accordingly, the polyester resin emulsion is obtained.

The polyester resin liquid, which is in a form of liquid droplets of 100 to 1000 nm, is emulsified in the water base medium in the obtained polyester resin emulsion.

When the polyester resin emulsion is prepared, the polyester resin liquid may be blended with the water base medium. Alternatively, the water base medium may be blended with the polyester resin liquid. When the water base medium is blended with the polyester resin liquid, it is also possible to use a phase inversion emulsifying method.

<1-1-5> Removal of Organic Solvent from Polyester Resin Emulsion

Subsequently, in order to prepare the suspension of the mother fine particles, the organic solvent is removed from the polyester resin emulsion.

In order to remove the organic solvent from the polyester resin emulsion, any known method is used, which includes, for example, the blowing, the heating, the pressure reduction, and any combination thereof.

In particular, the polyester resin emulsion is heated at a temperature of, for example, ordinary (normal) temperature to 90° C. and preferably 50 to 80° C., for example, in an inert gas atmosphere of nitrogen or the like to evaporate or volatilize the organic solvent. Accordingly, the suspension of the mother fine particles is obtained.

The volume average particle diameter of the mother fine particles in the suspension of the mother fine particles is, for example, 0.03 to 1 μm and preferably 0.05 to 0.5 μm as the median diameter.

<1-2> Aggregation and Fusion of Mother Fine Particles

Subsequently, in order to prepare the toner suspension, a coagulant or coagulating agent is added to the suspension of the mother fine particles to coagulate the mother fine particles. After that, the coagulated mother fine particles are united (fused) by means of the heating to form the toner mother particles.

In order to coagulate the mother fine particles, at first, the suspension of the mother fine particles is diluted with water, and the solid content concentration is adjusted to be, for example, 1 to 30% by mass and preferably 5 to 20% by mass.

In order to contemplate the dispersion stability in the coagulating/fusing step, a surfactant can be added when the dilution is performed, if necessary.

Those usable as the surfactant include, for example, polyoxyethylene polyoxypropyrene glycol (for example, polyoxyethylene polyoxypropyrene block copolymer), polyoxyalkylene decyl ether, polyoxyalkylene tridecyl ether, polyoxyethylene isodecyl ether, polyoxyalkylene lauryl ether, and polyoxyethylene alkyl ether. Preferably, polyoxyethylene polyoxypropyrene glycol is exemplified.

The surfactant is blended, for example, at a blending ratio of 0.5 to 20 parts by mass and preferably 1 to 10 parts by mass with respect to 100 parts by mass of the solid content of the suspension of the mother fine particles. When the surfactant is added to the suspension of the mother fine particles, then a surfactant aqueous solution may be previously prepared, and the surfactant aqueous solution may be added to the suspension of the mother fine particles.

Subsequently, in order to coagulate the mother fine particles, the coagulant is added to the suspension of the mother fine particles.

The coagulant is exemplified, for example, by inorganic metal salts such as aluminum chloride, calcium nitrate and the like; and polymers of inorganic metal salts such as polyaluminum chloride and the like.

In order to add the coagulant, a coagulant aqueous solution of, for example, 0.01 to 1.0 N (normal), preferably 0.05 to 0.5 N (normal) is prepared. The coagulant aqueous solution, which is, for example, in an amount of 0.1 to 10 parts by mass and preferably 0.5 to 5 parts by mass, is added to 100 parts by mass of the suspension of the mother fine particles.

At first, for example, the stirring or agitation is performed with a high speed dispersing machine such as a homogenizer or the like, and then a stirring blade or vane, which is, for example, a flat plate turbine blade, a propeller blade, or an anchor blade, is used to perform the stirring at such a number of revolutions that the tip peripheral speed is, for example, 1 to 2 m/second. The liquid temperature during the stirring is, for example, 10 to 50° C., preferably 20 to 30° C. The stirring time is, for example, 5 to 60 minutes, preferably 10 to 30 minutes.

Subsequently, a coagulation stopper or coagulating stopping agent is added to the suspension of the mother fine particles to stop the coagulation of the mother fine particles.

The coagulation stopper is exemplified, for example, by alkali metal salts such as sodium hydroxide, potassium hydroxide and the like. It is also possible to use an ionic surfactant.

In order to add the coagulation stopper, a coagulation stopper aqueous solution, which is, for example, 0.01 to 5.0 N (normal), preferably 0.1 to 2.0 N (normal), is prepared. The coagulation stopper aqueous solution is added in an amount of, for example, 0.5 to 20 parts by mass, preferably 1.0 to 10 parts by mass with respect to 100 parts by mass of the suspension of the mother fine particles.

Subsequently, the suspension of the mother fine particles is heated, for example, for 0.5 to 10 hours at a temperature which is not less than the glass transition temperature (Tg) of the mother fine particles, for example, 55 to 100° C., preferably 65 to 95° C., while stirring the suspension of the mother fine particles.

Accordingly, the coagulated mother fine particles are united or fused, and the spherical toner mother particles are formed.

Subsequently, the suspension of the mother fine particles is cooled, followed by being placed stationarily to precipitate the toner mother particles.

After that, the precipitated toner mother particles are washed with water, followed by being redispersed in water so that the solid content is, for example, 5 to 40% by mass to obtain the suspension of the toner mother particles.

The volume average particle diameter of the toner mother particles in the suspension of the toner mother particles is, for example, 3 to 12 μm, preferably 6 to 10 μm.

<2> Preparation of Electrification Control Resin Fine Particle Suspension

An electrification control resin fine particle suspension, in which electrification control resin fine particles containing an electrification control resin are dispersed, is prepared distinctly or separately (S2 in FIG. 1).

<2-1> Preparation of Electrification Control Resin Emulsion

In order to prepare the suspension of the fine particles of the electrification control resin, at first, the electrification control resin and an organic solvent are emulsified in water to prepare an emulsion of the electrification control resin.

The electrification control resin is a synthetic resin having a cationic group, which is blended in order to stably impart the positive electrification or charging to the toner.

The cationic group is exemplified, for example, by quaternary ammonium group, quaternary ammonium salt-containing group, amino group, and phosphonium salt-containing group. Preferably, the cationic group is exemplified by quaternary ammonium salt-containing group.

The synthetic resin is exemplified, for example, by acrylic resin, acryl-styrene resin, polystyrene resin, and polyester resin. Preferably, the synthetic resin is exemplified by acrylic resin and acryl-styrene resin. More preferably, the synthetic resin is exemplified by acryl-styrene resin.

The glass transition temperature (Tg) of the electrification control resin is, for example, 40° C. to 100° C. and preferably 55° C. to 80° C., in view of the storage stability and the thermal fixation performance of the toner.

Specifically, the electrification control resin containing the quaternary ammonium salt-containing group is exemplified, for example, by "FCA-207P" (product name) produced by Fujikura Kasei Co., Ltd. (copolymer composed of 83% by mass of styrene, 15% by mass of butyl acrylate, and 2% by mass of N,N-diethyl-N-methyl-2-(methacryloyloxy) ethylammonium=P-toluenesulfonic acid, weight average molecular weight (Mw): 12,000, glass transition temperature (Tg): 67° C.), "FCA-161P" (product name) produced by the same company, "FCA-78P" (product name) produced by the same company, and "FCA-201PS" (product name) produced by the same company (copolymer of butyl acrylate, N,N-diethyl-N-methyl-2-(methacryloyloxy)ethylammonium=p-toluenesulfonate, and styrene (N,N-diethyl-N-methyl-2-(methacryloyloxy)ethylammonium=p-toluenesulfonate content: 14% by mass), weight average molecular weight (Mw): 15000, glass transition temperature (Tg): 66° C.).

The organic solvent is exemplified by the organic solvents as described above. The organic solvents can be used singly or they can be used in combination.

In order to prepare the emulsion of the electrification control resin, at first, the electrification control resin is dissolved or swelled in the organic solvent to prepare a electrification control resin liquid. Subsequently, the electrification control resin liquid is emulsified in water.

In order to prepare the electrification control resin liquid, for example, the electrification control resin is blended in an amount of 5 to 100 parts by mass, preferably 10 to 50 parts by mass with respect to 100 parts by mass of the organic solvent, followed by being mixed with each other.

In order to emulsify the electrification control resin liquid in water, for example, the electrification control resin liquid is blended in an amount of, for example, 50 to 150 parts by mass, preferably 80 to 100 parts by mass with respect to 100 parts by mass of water, followed by being stirred, for example, at 5000 to 20000 rpm (tip peripheral speed: 4 to 17 m/s), preferably 7000 to 16000 rpm (tip peripheral speed: 7 to 14 m/s) for 5 to 60 minutes, preferably 10 to 30 minutes by using a high speed dispersing machine such as a homogenizer or the like.

Accordingly, the electrification control resin liquid is emulsified in water in a form of liquid droplets, and the emulsion of the electrification control resin is prepared.

<2-2> Preparation of Suspension of Fine Particles of Electrification Control Resin Subsequently, in order to obtain the suspension of the fine particles of the electrification control resin, the organic solvent is removed from the emulsion of the electrification control resin.

The method for removing the organic solvent from the emulsion of the electrification control resin is exemplified by the same method as the method for removing the organic solvent from the suspension of the mother fine particles as described above.

Accordingly, it is possible to obtain the suspension of the fine particles of the electrification control resin in which the fine particles of the electrification control resin are dispersed.

The amount of the cationic group existing on the surfaces of the fine particles of the electrification control resin in the suspension of the fine particles of the electrification control resin is, for example, $5.0\times10^{-5}$ to $6.0\times10^{-4}$ mol/g, preferably $1.0\times10^{-4}$ to $3.0\times10^{-4}$ mol/g.

The amount of the cationic group can be measured, for example, by the colloid titration method (flow potential method).

The volume average particle diameter of the fine particles of the electrification control resin in the suspension of the fine particles of the electrification control resin is, for example, 0.03 to 0.5 μm, preferably 0.05 to 0.3 μm as the median diameter.

<3> Fixation of Fine Particles of Electrification Control Resin to Toner Mother Particles Subsequently, in order to prepare the toner suspension, the suspension of the fine particles of the electrification control resin and the suspension of the toner mother particles are mixed with each other (S3).

In order to mix the suspension of the fine particles of the electrification control resin and the suspension of the toner mother particles, there is no special limitation. For example, the suspension of the fine particles of the electrification control resin is blended with the suspension of the toner mother particles, followed by being stirred by using the stirring blade such as the flat plate turbine blade or the like.

The suspension of the fine particles of the electrification control resin is blended with the suspension of the toner mother particles, for example, in such a blending amount that the solid content of the suspension of the fine particles of the electrification control resin (i.e., the electrification control resin) is, for example, 0.1 to 5 parts by mass, preferably 0.5 to 3 parts by mass with respect to the 100 parts by mass of the solid content of the suspension of the toner mother particles (i.e., the toner mother particles).

Subsequently, the mixture of the suspension of the fine particles of the electrification control resin and the suspension of the toner mother particles is heated (S4).

The heating condition is not specifically limited. For example, when Tg (glass transition temperature) of the toner mother particles is lower than Tg of the electrification control resin, the heating is performed for 10 to 60 minutes at a temperature within a range of +0 to 5° C. with respect to Tg of the toner mother particles. When Tg of the toner mother particles is higher than Tg of the electrification control resin, the heating is performed for 10 to 60 minutes at a temperature within a range of +0 to 5° C. with respect to Tg of the electrification control resin.

pH of the mixture during the heating is adjusted, for example, to pH 6 to 10.5, preferably pH 6 to 8 by adding a pH adjusting agent such as alkali metal salt or the like.

Accordingly, the toner spheres (spherical toner particles), in which the fine particles of the electrification control resin are fixed or secured to the surfaces of the toner mother particles, are formed to obtain the toner suspension in which the spherical toner particles are dispersed.

2. Addition of External Additive

After that, an external additive is added to the toner suspension, if necessary (S5). The external additive is added in order to adjust, for example, the electrification performance (charging performance), the fluidity, and the storage stability of the toner. The external additive is composed of particles having a particle diameter (particle size) which is extremely smaller than that of the toner mother particles.

The external additive is exemplified, for example, by inorganic particles such as silica, aluminum oxide, titanium oxide, silicon aluminum cooxide, silicon titanium cooxide, hydrophobic treated material thereof (for example, hydrophobic treated material of silica can be obtained by treating fine powder of silica with silicone oil and/or silane coupling agent (for example, dichlorodimethylsilane, hexamethyldisilazane, and tetramethyldisilazane) and the like; and synthetic resin particles such as methacrylic acid ester polymer particles, acrylic acid ester polymer particles, styrene-methacrylic acid ester copolymer particles, styrene-acrylic acid ester copolymer particles, core-shell type particles having core composed of styrene polymer and shell composed of methacrylic acid ester polymer and the like.

In order to add the external additive, for example, the external additive is dispersed in a solvent such as ethanol or the like to prepare an external additive dispersion. The external additive dispersion is added to the toner suspension, followed by being mixed with each other.

The blending of the external additive is not specifically limited. However, the external additive is blended in an amount of, for example, 0.1 to 6 parts by mass with respect to 100 parts by mass of the solid content of the toner suspension (i.e., the spherical toner particles).

3. Formation of Toner Block

<1> Adjustment of Water Amount of Toner Suspension

Subsequently, in order to form the toner block, the water amount of the toner suspension is adjusted, for example, to 32.5 to 37% by mass, preferably 33 to 35% by mass (S6).

If the water amount of the toner suspension exceeds the range as described above, then the spherical toner particles are aggregated or assembled with each other relatively densely in the obtained toner block, and it is difficult to collapse the toner block, which is not preferred.

If the water amount of the toner suspension is less than the range as described above, the toner suspension is in a form of cake having no fluidity (i.e., aggregate of the spherical toner particles (as described later on)) in some cases, which is not preferred.

In order to adjust the water amount of the toner suspension, for example, the toner suspension is filtrated so that the water amount described above is obtained.

In particular, at first, the toner suspension is diluted with distilled water so that the solid content is 10% by mass (i.e., the water amount is 90% by mass). Subsequently, the diluted toner suspension (water amount: 90% by mass) is filtrated. In this procedure, the mass of the recovered filtrate is measured. When the filtrate, which has such an amount that the water amount of the toner suspension is within the range as described above, is recovered, the filtration is stopped.

The toner suspension, in which the water amount is adjusted as described above, is a dilatant fluid which exhibits the dilatancy. Here, the dilatant fluid is a fluid having anomalous viscosity such that apparent viscosity thereof is increased with increasing shearing stress. In other words, the dilatant fluid behaves like a solid matter with respect to drastic deformation, and keeps a fluid state with respect to slow deformation.

<2> Water Absorption and Drying

Subsequently, in order to form the toner block, the toner suspension, in which the water amount is adjusted, is poured into a water absorptive material vessel formed of a water absorptive material (absorption material or absorbent) (S7).

The water absorptive material vessel is formed to have a bottom-equipped frame-shaped form which is provided with a bottom wall and side walls provided upstandingly from the bottom wall. The entire water absorptive material vessel is formed of the water absorptive material.

The water absorptive material is exemplified, for example, by porous filter such as filter paper, membrane filter, nonwoven fabric filter (for example, glass fiber filter) and the like; porous material such as sponge-like porous material such as porous ceramics, rubber foam and the like; and cloth or textile such as nonwoven fabric, woven fabric, knit fabric and the like.

The water absorption speed of the water absorptive material is such a water absorption speed that 0.2 ml of water is absorbed, for example, within 3 minutes, preferably within 2 minutes. In other words, the water absorption speed of the water absorptive material is not less than 0.0011 ml/second, preferably not less than 0.0017 ml/second.

The water absorption amount per unit mass (1 g) of the water absorptive material is, for example, 0.9 to 10 g, preferably 1 to 5 g.

When the toner suspension is poured into the water absorptive material vessel, then a part of water contained in the toner suspension is absorbed by the water absorptive material vessel, and the aggregate of the spherical toner particles is formed to have a block shape corresponding to the shape of the water absorptive material vessel. The aggregate of the spherical toner particles is cake-shaped. Water, which is not absorbed by the water absorptive material vessel, is contained in the aggregate of the spherical toner particles.

The time (water absorption time, the same definition holds in the followings), which elapses until the aggregate of the spherical toner particles is formed after pouring the toner suspension into the water absorptive material vessel, is, for example, not more than 150 seconds, preferably not more than 100 seconds.

In order to measure the water absorption time, at first, for example, the toner suspension (blended with silica) is poured into the water absorptive material vessel, simultaneously with which the measurement is started. Subsequently, the measurement is completed at an end point which is provided when the excessive water (water in a state of being allowed to leak out from the surface of the aggregate) is absorbed from the aggregate of the spherical toner particles by the water absorptive material.

The water content of the aggregate of the spherical toner particles is, for example, not more than 32.3% by mass, preferably not more than 31.8% by mass.

In order to measure the water content, at first, for example, about 1 g (mass before the drying) of the obtained aggregate of the spherical toner particles is sampled. Subsequently, the sampled aggregate is dried to measure the mass (mass after the drying) of the dried aggregate. The percentage of the mass after the drying with respect to the mass before the drying is designated as the water content.

Subsequently, the water absorptive material vessel is used as a mold, and the aggregate of the spherical toner particles is dried, for example, by means of a drying method such as the air drying or the like (S8).

Accordingly, the toner block, in which the spherical toner particles are aggregated or assembled, is formed.

Figure 4A:
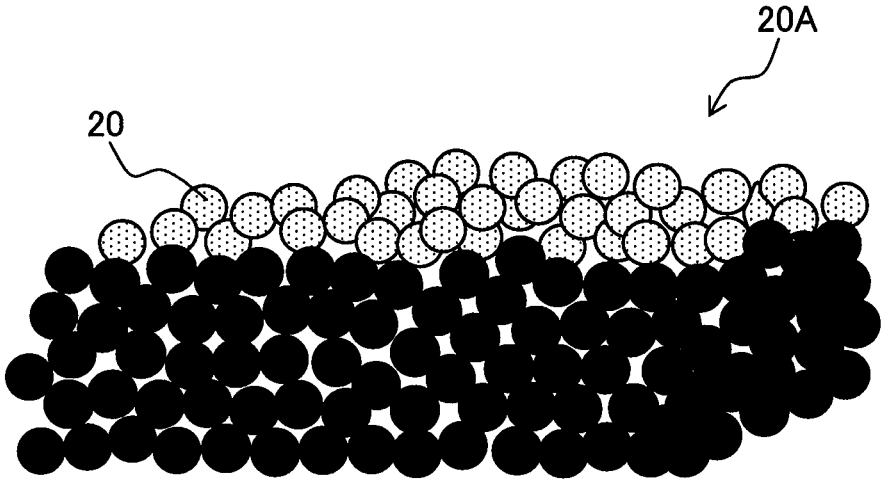
FIG. 4A schematically shows an internal structure of the toner block in a form of cake, and FIG. 4B schematically shows an internal structure of tightly aggregated toner block.
Figure 4B:
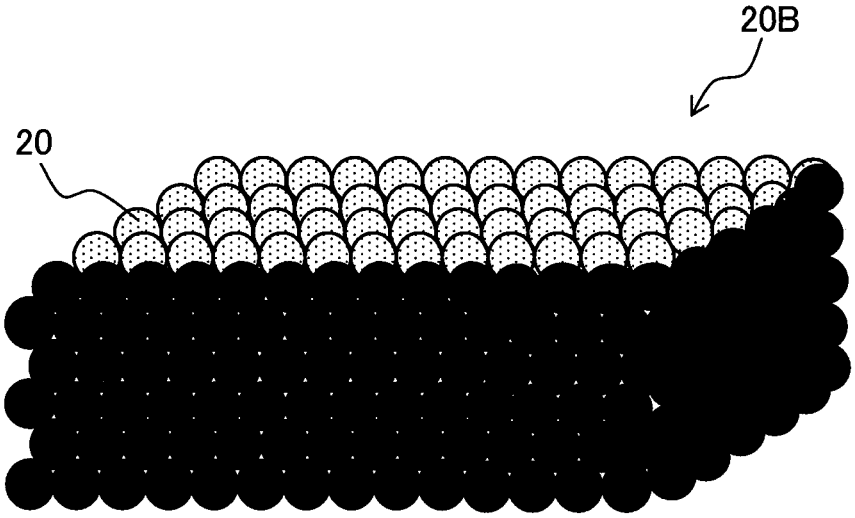

An object having the dilatancy such as the dilatant fluid exhibits fluidity like liquid in a stationary state. Thus, it is considered that there is a space required for exhibiting the fluidity between toner particles in the toner suspension in which the water amount is adjusted. On the other hand, the dilatant fluid exhibits the dilatancy only when the water amount is in a predetermined range. When the water amount is less than the predetermined range, the dilatant fluid does not exhibit the dilatancy and the fluidity thereof is lost. Here, when water is removed from the toner suspension which is the dilatant fluid, the toner particles are fixed or immobilized each other in a state that the space between toner particles is kept to some extent. As a result, as shown in FIG. 4A, a toner block as toner coagulation in which a small space is formed between the toner particles is formed. The words "an aggregation of the spherical toner particles in a form of cake" in the present teaching means that the spherical toner particles are fixed or immobilized each other in a state that the space between toner particles is kept to some extent, as shown in FIG. 4A. The toner block formed in this manner has the space between the toner particles, and a cohesive force between the toner particles is loose, thereby being capable of crushing or pulverizing the toner particles into individual toner particles by a relatively small stress. On the other hand, when water is removed from the toner suspension which is not the dilatant fluid to form the toner block, the toner particles are tightly fixed or immobilized each other, as shown in FIG. 4B. Thus, the cohesive force between the toner particles is strong, it is not possible to crush or pulverize the toner particles into individual toner particles by the relatively small stress.

Here, as described above, when the toner suspension in which the water amount is adjusted is poured into the water absorptive material vessel formed of the water absorptive material, water is quickly transferred from the toner suspension to the water absorptive material. As a result, the toner particles are fixed or immobilized each other in a state that the space is formed between the toner particles (loose coagulation state). Further, when the toner suspension is poured onto the fixed toner particles, water is quickly transferred from the toner suspension to the water absorptive material through the space between the fixed toner particles. As a result, even when the toner suspension is additionally poured, the toner particles are fixed or immobilized each other in a state that the space is formed between the toner particles (loose coagulation state). As described above, it is possible to quickly remove water from the toner suspension by pouring the toner suspension in which the water amount is adjusted into the water absorptive material vessel and it is possible to easily form the toner block as the toner coagulation in which the small space is formed between the toner particles.

4. Toner Block

The bulk density of the obtained toner block is, for example, 0.3 to 0.8 g/ml, preferably 0.45 to 0.7 g/ml.

The filling rate of the obtained toner block is, for example, 30 to 69%, preferably 39 to 65%.

The maximum compressive stress of the obtained toner block is, for example, 80000 to 550000 $N/m^2$, preferably 90000 to 500000 $N/m^2$. The magnitude of internal stress of the toner block (the maximum compressive stress, the maximum shearing stress described later on, etc.) corresponds to the magnitude of stress required for crushing or pulverizing the toner block into a powder form (disaggregate toner particles) inside a development unit.

In order to measure the maximum compressive stress of the toner block, at first, the toner block is cut to form a substantially prism-shaped test piece.

In particular, as for the size of the test piece, it is assumed that the length of one arbitrary side (designated as "longitudinal side", the same definition holds in the followings) is the longitudinal length, the length of another side (designated as "lateral side", the same definition holds in the followings) perpendicular to the longitudinal side is the lateral length, and the length of one side perpendicular to both of the longitudinal side and the lateral side is the thickness. On this assumption, the longitudinal length is, for example, 10 to 20 mm, the lateral length is, for example, 10 to 20 mm, and the thickness is, for example, 5 to 10 mm.

Figure 2A:
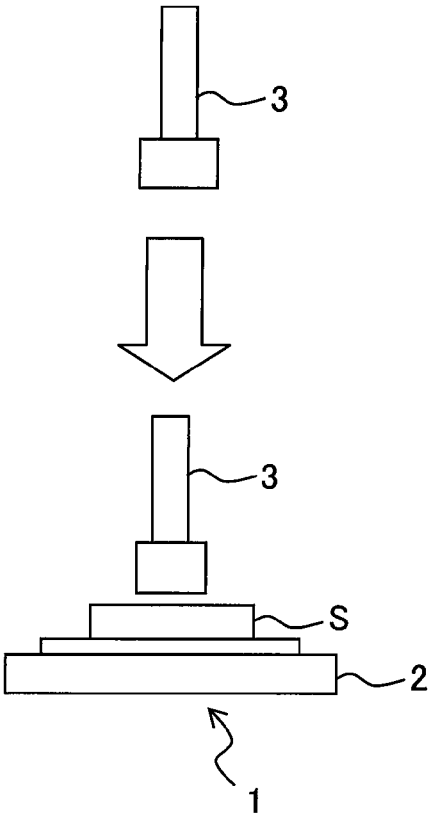

Subsequently, in order to measure the maximum compressive stress of the toner block, as shown in FIG. 2A, the test piece S is pressed or pressurized in the thickness direction by using a compressive test machine 1, and the pressing force (pressurizing force), which is applied when the test piece S is collapsed, is measured.

The compressive test machine 1 is provided with a base 2 on which the test piece S is placed, and a compressing member 3 which is provided on the upper side of the base 2 with a spacing distance intervening therebetween.

The base 2 has its upper surface which is a horizontal surface for horizontally placing the test piece S thereon. Minute irregularities (protrusions/recesses) are formed on the horizontal surface so that the test piece S does not slip.

The compressing member 3 is formed to have a substantially cylindrical shape extending in the upward-downward direction. The compressing member 3 is provided movably back and forth in the upward-downward direction. The diameter of the lower surface of the compressing member 3 is shorter than both of the longitudinal length and the lateral length of the test piece S. Specifically, the diameter of the lower surface of the compressing member 3 is 5 to 10 mm.

A commercially available powder fluidity test machine is alternatively usable as the compressive test machine 1 as described above. For example, it is possible to use Powder Rheometer FT-4 (produced by Freedman Technology).

The test piece S is placed on the upper surface of the base 2 so that the thickness direction of the test piece S is directed in the upward-downward direction, and the compressing member 3 is moved downwardly without rotating the compressing member 3.

Accordingly, the lower surface of the compressing member 3 is allowed to abut against the upper surface of the test piece S from the upper side, and the test piece S is pressurized by the compressing member 3.

Further, the pressing force (pressurizing force) of the compressing member 3, which is exerted on the test piece S, is gradually increased until the test piece S is collapsed by the compressing member 3 to measure the pressing force of the compressing member 3 exerted on the test piece S when the test piece S is collapsed by the compressing member 3.

The measured pressing force is divided by the areal size of the lower surface of the compressing member 3 to obtain the maximum compressive stress of the toner block.

On the other hand, the maximum shearing stress of the obtained toner block is, for example, 120 to 1800 $N/m^2$, preferably 150 to 1650 $N/m^2$.

Figure 2B:
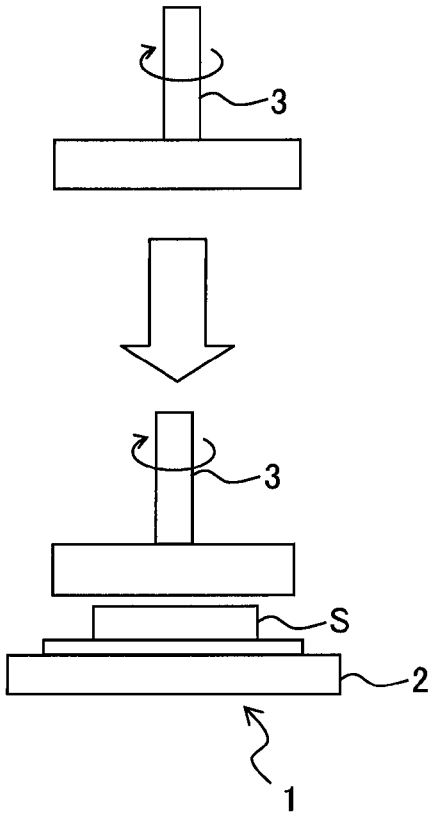

In order to measure the maximum shearing stress of the toner block, as shown in FIG. 2B, the compressive test machine 1 described above is used, and the test piece S is placed on the upper surface of the base 2 so that the thickness direction of the test piece S is directed in the upward-downward direction. The compressing member 3 is moved downwardly while rotating the compressing member 3.

In this situation, the compressing member 3 is moved downwardly while being rotated. Therefore, one arbitrary point P, which is disposed on the outer circumferential surface of the compressing member 3, is moved to depict a helix in accordance with the downward movement of the compressing member 3. The helix angle of the helix is, for example, about 30°.

The diameter of the lower surface of the compressing member 3 is longer than both of the longitudinal length and the lateral length of the test piece S. Specifically, the diameter of the lower surface of the compressing member 3 is about 50 mm.

The shearing force, which is exerted on the test piece S by the compressing member 3 when the test piece S is collapsed by the compressing member 3, is measured.

The measured shearing force is divided by the areal size of the upper surface of the test piece S to obtain the maximum shearing stress of the toner block.

The maximum shearing stress is divided by the thickness of the test piece S to obtain the shearing stress per unit thickness of the toner block.

The shearing stress per unit thickness of the toner block is, for example, 25000 to 230000 $N/m^2$, preferably 30000 to 200000 $N/m^2$.

5. Charging of Toner Block to Developing Cartridge

Figure 3:
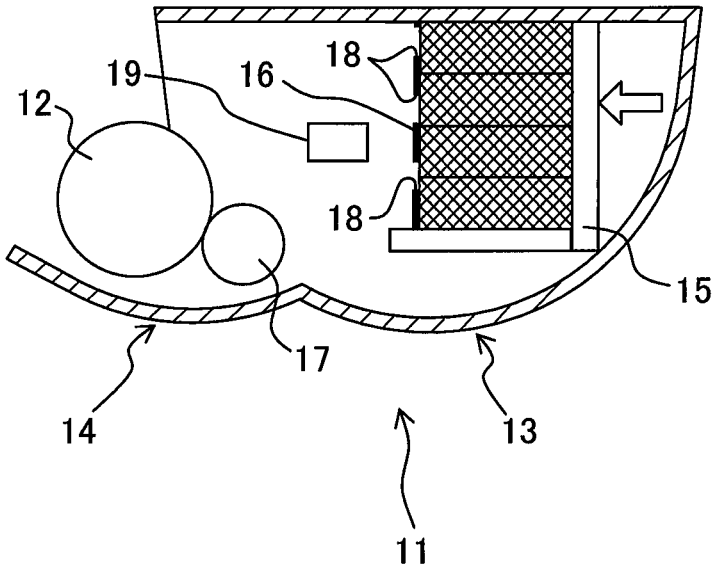
FIG. 3 shows an illustrative view illustrating the charge of the toner block of the present invention.

As shown in FIG. 3, the toner block is charged into a development unit 11 which is provided for an image forming apparatus (not shown) such as a laser printer or the like.

The development unit 11 includes a developing roller 12 which is provided at one end portion in order to carry the toner. The development unit 11 is formed to have a substantially box-shaped form which is lengthy in the axial direction of the developing roller 12. Further, the development unit 11 is provided with a toner accommodating section 13 which accommodates the toner block, and a developing section 14 which rotatably supports the developing roller 12.

The toner accommodating section 13 is provided at a half portion of the development unit 11 disposed on the other side, which is formed to have a substantially box-shaped form. The toner accommodating section 13 is provided with a pressing member 15 and a cutting exfoliation member 16.

The pressing member 15 is formed to have a flat plate-shaped form extending in the axial direction of the developing roller 12. The pressing member 15 is arranged on one side of the wall of the toner accommodating section 13 disposed on the other side in the toner accommodating section 13. Further, the pressing member 15 is provided slidably in one direction and the other direction. The pressing member 15 is always urged by an urging member (not shown) from the other side toward one side.

The cutting exfoliation member 16 is arranged opposingly on one side of the pressing member 15, which is formed to have a flat plate-shaped form having a large number of through-holes 18. Specifically, the cutting exfoliation member 16 is formed by a porous plate such as a punching metal or the like or a mesh-shaped member such as a metal mesh or the like. Further, the cutting exfoliation member 16 is formed reciprocatively slidably in the axial direction of the developing roller. The cutting exfoliation member 16 is allowed to slide in accordance with the driving force transmitted from a driving source (not shown) on the basis of an empty signal supplied from a sensor 19 which is provided at one end portion of the toner accommodating section 13.

The developing section 14 is provided at a half portion of the development unit 11 disposed on one side so that the developing section 14 is communicated with the toner accommodating section 13. The developing section 14 is provided with a supply roller 17.

The supply roller 17 is arranged on the other side of the developing roller 12. The supply roller 17 is brought in contact with the developing roller 12 from the other side.

In order to charge the toner block into the development unit 11, the toner block is arranged between the pressing member 15 and the cutting exfoliation member 16 while allowing the pressing member 15 to slide toward the other side against the urging force of the urging member (not shown).

When the pressing member 15 is released from the sliding movement toward the other side, then the pressing member 15 is allowed to slide toward one side by the urging force of the urging member (not shown), and the pressing member 15 is allowed to abut against the toner block from the other side. Accordingly, the toner block is pressed toward the cutting exfoliation member 16 by the pressing member 15. The toner block is allowed to abut against the cutting exfoliation member 16 at one end portion. That is, the toner block is interposed between the pressing member 15 and the cutting exfoliation member 16.

Accordingly, the charging of the toner block into the development unit 11 is completed.

6. Developing Operation

When the development unit 11, into which the toner block is charged, is driven in the image forming apparatus (not shown), the cutting exfoliation member 16 is allowed to reciprocatively slide in the axial direction of the developing roller 12.

Accordingly, the toner block, which is allowed to abut against the cutting exfoliation member 16, is compressed, sheared, and pulverized, and the toner block is unbound into a powder form. In this procedure, the aggregated spherical toner particles are separated from each other, the spherical toner particles are allowed to pass through the through-holes 18 of the cutting exfoliation member 16, and the spherical toner particles are supplied to the developing section 14.

The spherical toner particles, which are supplied to the developing section 14, are frictionally electrified (charged) between the developing roller 12 and the supply roller 17, and the spherical toner particles are supplied to a photosensitive member (not shown).

7. Function and Effect

According to the toner block of the present invention, the toner block is formed by aggregating or assembling the spherical toner particles. Therefore, when the toner block is charged into the developing cartridge, it is possible to prevent the spherical toner particles from being scattered.

Further, the toner block is adjusted to have the bulk density of 0.3 to 0.8 g/ml. Further, the toner block is adjusted to have the filling rate of 30 to 69%.

That is, the toner block is formed by aggregating (coagulating) the spherical toner particles with each other relatively loosely.

Specifically, the maximum compressive stress of the toner block is 80000 to 550000 $N/m^2$, and the maximum shearing stress of the toner block is 120 to 1800 $N/m^2$.

Therefore, the toner block can be unbound with ease to provide the powder of the spherical toner particles in the developing cartridge.

EXAMPLES

The method for producing the toner block will be explained more specifically below as exemplified by Examples. In the following explanation, the "part" and "%" are based on the mass, unless specifically noted. Various physical properties were measured in accordance with the measuring methods as described later on.

Example 1

1. Preparation of Toner Suspension

<1> Preparation of Suspension of Toner Mother Particles

<1-1> Preparation of Suspension of Mother Fine Particles

<1-1-1> Preparation of Polyester Resin Emulsion 15 parts by mass of polyester resin (ER508, Tg: 62.1° C., Mn (number average molecular weight): 3700, Mw (weight average molecular weight): 113000, gel content: less than 2 wt %, acid value: 6.8 KOH mg/g, produced by Mitsubishi Rayon Co. Ltd.), 15 parts by mass of carbon black (#260, produced by Mitsubishi Chemical Corporation), and 70 parts by mass of MEK (produced by Kanto Kagaku, Cica 1st grade) were mixed with each other and stirred for 10 minutes at a number of revolutions of 10000 rpm by means of a homogenizer (rotor stator type, shaft 22F, DIAX-900 type, produced by Heidolph), and thus a coloring agent dispersion was obtained.

100 parts by mass of the coloring agent dispersion was introduced into a bead mill (RMB-04, produced by IMEX Co., Ltd.) together with 450 parts by mass of zirconia beads (diameter: 1 mm), followed by being treated for 60 minutes at a stirring velocity of 2000 rpm.

Subsequently, 671.15 parts by mass of MEK was slowly mixed with 60.6 parts by mass of the coloring agent dispersion. After that, 150.9 parts by mass of polyester resin (ER508) and 12.73 parts by mass of ester-based wax (Nissan Elector WEP3, produced by NOF CORPORATION) were mixed and stirred, and the mixture was heated and stirred at a liquid temperature of 70° C. to obtain a polyester resin liquid.

900 parts by mass of distilled water and 9.0 parts by mass of 1 N aqueous sodium hydroxide solution were distinctly mixed with each other, and the mixture was heated to 70° C. to obtain a water base medium.

The entire amount of the water base medium and the entire amount of the polyester resin liquid were introduced into a 2 L beaker, followed by being mixed with each other. The mixture was stirred and emulsified for 30 minutes at a number of revolutions of 16000 rpm by means of a homogenizer to obtain a polyester resin emulsion.

<1-1-2> Removal of Organic Solvent from Polyester Resin Liquid

The polyester resin emulsion was heated and stirred at 80° C. while feeding nitrogen to the gaseous phase to remove MEK, and a suspension of mother fine particles, in which mother fine particles were dispersed, was obtained.

The solid content concentration of the suspension of the mother fine particles was 23.1% by mass.

The volume average particle diameter of the mother fine particles in the suspension of the mother fine particles was 0.275 μm as a median diameter.

<1-2> Coagulation and Fusion of Mother Fine Particles

Subsequently, the suspension of the mother fine particles was transferred to a 2 L round separable flask, with which 60 parts by mass of 5% aqueous solution of nonionic surfactant (Noigen XL-70, produced by Dai-ichi Kogyo Seiyaku Co. Ltd.) was mixed, followed by being diluted with distilled water to prepare 1600 parts by mass of a diluted liquid of the suspension of the mother fine particles having a solid content concentration of 10%.

31 parts by mass of 0.2 N aluminum chloride aqueous solution was added as a coagulant to the diluted liquid, followed by being mixed at a high speed at a number of revolutions of 8000 rpm by means of a homogenizer.

The stirring was performed for 5 minutes by using the homogenizer, and then 6 parts by mass of 0.2 N sodium hydroxide aqueous solution was introduced, followed by being further stirred for 5 minutes at a number of revolutions of 8000 rpm by means of the homogenizer.

After that, the stirring was performed for 30 minutes with six flat plate turbine blades (ϕ75 mm) set to provide such a number of revolutions that the tip peripheral speed was about 1.3 m/second, while heating the 2 L separable flask in a water bath at 45° C. to coagulate the mother fine particles. After that, 40 parts by mass of 0.2 N sodium hydroxide aqueous solution was introduced as a coagulation stopper, and then the six flat plate turbine blades (ϕ75 mm) were decelerated so that the tip peripheral speed was about 0.75 m/second, followed by being stirred for 10 minutes.

After that, the temperature was raised to 95° C. at a temperature-raising speed of 1° C./minutes, while continuing the stirring, and the stirring was performed at 95° C. for 150 minutes.

The suspension of the mother fine particles was observed by using an optical microscope, and it was confirmed that the spherical toner mother particles were formed. After that, the cooling was performed.

After the cooling, the particle diameter of the toner mother particles was measured by Coulter Multisizer II (aperture diameter: 100 μm, produced by Beckman Coulter).

The number average particle diameter Dn of the toner mother particles was 7.12 μm, and the volume average particle diameter Dv of the toner mother particles was 8.27 μm.

The toner mother particles, which had the number-based particle diameter of not more than 5 μm, were contained by 7.3%.

The toner mother particles, which had the volume-based particle diameter of not more than 20 μm, were contained by 0.43%.

The cooled suspension of the toner mother particles was left to stand overnight to precipitate the toner mother particles, and the supernatant was discarded.

After that, 500 parts by mass of distilled water was added to the precipitated toner mother particles, followed by being stirred to redisperse the toner mother particles. The filtration was performed by using filter paper (No. 5B, produced by ADVANTEC TOYO).

The filtration residue (toner mother particles) was redispersed in distilled water to obtain a toner mother particle suspension having a solid content of 10% by mass.

<2> Preparation of Suspension of Fine Particles of Electrification Control Resin <2-1> Preparation of Emulsion of Electrification Control Resin An electrification control resin (product name: "FCA-201PS", produced by Fujikura Kasei Co., Ltd.) was prepared.

82.5 parts by mass of MEK and 17.5 parts by mass of the electrification control resin were mixed and stirred, and the electrification control resin was dissolved in MEK to obtain an electrification control resin liquid.

100 parts by mass of distilled water was mixed with the entire amount of the electrification control resin liquid, followed by being stirred and emulsified for 20 minutes at a number of revolutions of 16000 rpm (tip peripheral speed: 10.5 m/s) by using a homogenizer (rotor stator type, shaft 18F, rotor diameter: 12.5 mm, DIAX-900 type, produced by Heidolph) to obtain an emulsion of electrification control resin.

<2-2> Preparation of Suspension of Fine Particles of Electrification Control Resin The obtained emulsion was transferred to a 1 L separable flask, and MEK was volatilized and removed by performing the heating and the stirring for 45 minutes at 60° C. while feeding nitrogen to the gaseous phase to obtain an electrification control resin fine particle suspension in which the fine particles of the electrification control resin were dispersed (solid content: 19.5% by mass).

<3> Fixation of Fine Particles of Electrification Control Resin to Toner Mother Particles 1600 parts by mass of the suspension of the toner mother particles (solid content: 10% by mass) obtained in (1-2) described above was heated and stirred for 20 minutes in a hot water bath at 60° C. while performing the stirring at 150 rpm by means of six flat plate turbine blades (ϕ75 mm).

Subsequently, 8.21 parts by mass of the suspension of the fine particles of the electrification control resin (solid content: 19.5% by mass) (1.6 parts by mass as the fine particles of the electrification control resin) was mixed with the heated toner mother particle suspension to prepare a mixture liquid which was stirred for 20 minutes while maintaining the bath temperature.

After that, the mixture liquid was cooled to about 30° C. while performing the stirring. The filtration residue (spherical toner particles), which was obtained by performing the filtration, was washed twice with 500 parts by mass of distilled water. After that, distilled water was added to obtain a toner suspension having a solid content of 10% by mass.

2. Addition of External Additive 1.5 parts by mass of HVK2150 (hydrophobic silica, BET specific surface area: 90 to 130 mg/100 ml, produced by Clariant) and 2.5 parts by mass of NA50Y (hydrophobic silica, BET specific surface area: 30 to 50 mg/100 ml, produced by Aerosil) were distinctly blended with 10 parts by mass of ethanol (produced by Kanto Kagaku, Cica 1st grade), and the ultrasonic treatment was performed by using an ultrasonic dispersing machine (28 kHz, 650 W) to obtain a silica dispersion.

14 parts by mass of the obtained silica dispersion was added to 1500 parts by mass of the toner suspension (solid content: 10% by mass) obtained in (3) described above, and the ultrasonic treatment was performed by using an ultrasonic dispersing machine (28 kHz, 650 W).

After that, the toner suspension, which was added with the silica dispersion, was filtrated, and the obtained filtration residue (silica-blended spherical toner particles) was washed twice with 500 parts by mass of distilled water. After that, distilled water was added to obtain a toner suspension (silica-blended) having a solid content of 10% by mass.

3. Formation of Toner Block

<1> Adjustment of Water Amount of Toner Suspension (Silica-Blended)

The obtained toner suspension (silica-blended) (solid content: 10% by mass, water content: 90% by mass) was filtrated (filter paper: No. 5B, produced by ADVANTEC TOYO), and the water content of the toner suspension (silica-blended) was adjusted to the water amount shown in Table 2. The obtained toner suspension (silica-blended) was a dilatant fluid.

Whether or not the obtained toner suspension (silica-blended) is the dilatant fluid was judged by checking the following two phenomena. First, when about 30 ml of a sample of the toner suspension was charged in a 50 ml beaker and left, it was checked as to whether a surface of the sample of the toner suspension was as smooth as a liquid surface. Second, a stainless-steel plate (width 20 mm, length 200 mm, thickness 1 mm) was vertically inserted into the beaker charged with the sample of the toner suspension and then pulled the stainless-steel plate upwardly in the vertical direction at a rate of 3 m/second. In this situation, it was checked as to whether at least one part of the beaker was lifted along with the stainless-steel plate. Note that the stainless-steel plate was inserted into the sample of the toner suspension by about 30 mm. By checking the two phenomena described above, it was checked as to whether "apparent viscosity was increased with increasing shearing stress" in the toner suspension and as to whether the toner suspension was the dilatant fluid. By the former phenomenon, it is possible to check as to whether the toner suspension "exhibits fluidity with respect to slow deformation", and by the latter phenomenon, it is possible to check as to whether the toner suspension "behaves like a solid matter with respect to drastic deformation".

<2> Water Absorption and Drying

The toner suspension (silica-blended), in which the water amount was adjusted, was poured into a water absorptive material vessel having a substantially rectangular bottom-equipped frame-shaped form (length 300 mm×width 300 mm×depth 15 mm) composed of a water absorptive material of the type shown in Table 2 described below, and water was absorbed to obtain an aggregate or assembly of the spherical toner particles. Ten sheets of the same water absorptive material as the water absorptive material for forming the water absorptive material vessel were overlapped and arranged under or below the water absorptive material vessel.

The period of time (water absorption time), which elapsed until the aggregate of the spherical toner particles was obtained after pouring the toner suspension (silica-blended) into the water absorptive material vessel, is shown in Table 2.

In order to measure the water absorption time, at first, the toner suspension (silica-blended) was poured into the water absorptive material vessel, simultaneously with which the measurement was started. Subsequently, the measurement was completed at the end point which was provided when the excessive water (water in a state of being allowed to leak out from the surface of the aggregate) was absorbed from the aggregate of the spherical toner particles by the water absorptive material.

The water content of the obtained aggregate of the spherical toner particles is shown in Table 2.

In order to measure the water content, at first, about 1 g (mass before the drying) of the obtained aggregate of the spherical toner particles was sampled, and then the sampled aggregate was dried to measure the mass (mass after the drying) of the dried aggregate. The percentage of the mass after the drying with respect to the mass before the drying was designated as the water content.

Subsequently, the water absorptive material vessel was used as a mold, and the aggregate of the spherical toner particles was dried by means of the air drying. Thus, a toner block was obtained.

Examples 2 to 16

Toner blocks were obtained in the same manner as in Example 1 except that the water amounts of toner suspensions (silica-blended) were adjusted as shown in Table 2 to obtain aggregates of spherical toner particles having the water contents shown in Table 2 by using the water absorptive materials shown in Table 2. Note that, it was checked that the toner suspensions (silica-blended), in which the water amounts were adjusted, were dilatant fluids by using the method described above.

Comparative Example 1

A toner block was obtained in the same manner as in Example 1 except that a toner suspension (silica-blended) (solid content: 10% by mass, water content: 90% by mass) was introduced into the water absorptive material vessel without adjusting the water amount of the toner suspension (silica-blended). The toner suspension (silica-blended) was not a dilatant fluid.

Comparative Examples 2 to 6

Toner blocks were obtained in the same manner as in Example 1 except that the water amounts of toner suspensions (silica-blended) were adjusted as shown in Table 2 to obtain aggregates of spherical toner particles having the water contents shown in Table 2 by using the water absorptive materials shown in Table 2. The toner suspensions (silica-blended), in which the water amounts were adjusted, were not dilatant fluids.

Method for Measuring Solid Content 2 to 20 g of a measurement objective was sampled in an aluminum vessel to measure the mass before the drying. The drying was performed for not less than 24 hours in a drying machine at 47° C. in which the interior was in an air blasting environment to measure the mass of the nonvolatile content. The percentage of the mass of the nonvolatile content with respect to the mass before the drying was calculated as the solid content (% by mass).

Measurement of Average Particle Diameter of Mother Fine Particles

The volume average particle diameter of the mother fine particles in each of the suspension of the mother fine particless was measured by using Microtrack particle size distribution measuring apparatus (UPA150, produced by Nikkiso Co., Ltd.).

Pure water was used as a dilution solvent. The refractive index of the solvent was set to 1.33, and the refractive index of the mother fine particles was set to 1.91.

Measurement of Average Particle Diameter of Toner Mother Particles and Spherical Toner Particles Particle size distribution measuring apparatus (Coulter Multisizer II produced by Beckman Coulter) was used. The measurement was performed by using the apparatus in which the aperture diameter was 100 μm.

<1> Average Particle Diameter of Toner Mother Particles

The suspension of the toner mother particles was introduced into the measuring unit of the particle size distribution measuring apparatus so that an appropriate amount concentration range indicated by the display unit of the apparatus was obtained to measure the volume-based average particle diameter.

<2> Average Particle Diameter of Spherical Toner Particles

<2-1> Spherical Toner Particles in Toner Suspension

Several drops (3 to 5 drops) of the toner suspension were introduced into the measuring unit of the particle size distribution measuring apparatus by a filler or dripping pipette (2 ml) to measure the volume-based average particle diameter. Results are shown in Table 2.

<2-2> Spherical Toner Particles in Toner Block

The toner block was placed or installed on a mesh (aperture diameter/wire diameter=250 μm/173 μm), and the toner block was rubbed against the mesh so that the toner block was pressed at a pressure of 30 g/cm$^2$.

About 45 mg of the spherical toner particles, which were allowed to pass through the mesh, were sampled or collected, which were dispersed in 250 ml of aqueous solution of 4% by mass of dispersing agent (COULTER Dispersant Type IC NONIONIC) to obtain a dispersion. The dispersing process was carried out for 30 seconds by using an ultrasonic washing machine (ULTRASONIC CLEANER VS-100, 50 Hz, 100 W).

The obtained dispersion was introduced into the measuring unit of the particle size distribution measuring apparatus so that an appropriate amount concentration range indicated by the display unit of the apparatus was obtained to measure the volume-based average particle diameter. Results are shown in Table 2.

Evaluation of Water Absorption Performance of Water Absorptive Material

<1> Water Absorption Degree

The water absorptive material, which was cut into a band-shaped slender form having a width of about 1 cm, was allowed to stand in distilled water at 20° C. to measure the height of water raised during a period of time of 10 minutes. Results are shown in Table 1.

<2> Water Absorption Amount

At first, the water absorptive material was allowed to absorb water by using a filler or dripping pipette.

Subsequently, excessive water (water allowed to leak out from the surface of the water absorptive material) was wiped out at the point in time at which the water absorptive material did not absorb water (at the point in time at which water was allowed to leak out to the surface of the water absorptive material and the glossiness of the surface of the water absorptive material appeared), and then the mass of the water absorptive material after the water absorption was measured.

The mass of the water absorptive material not subjected to the water absorption was distinctly measured, and the water absorption amount per unit mass was calculated from the following expression. Results are shown in Table 1.

Expression: ("mass of water absorptive material after water absorption"−"mass of water absorptive material not subjected to water absorption")/"mass of water absorptive material not subjected to water absorption"

<3> Water Absorption Speed 0.2 ml of distilled water was dripped onto the water absorptive material by using a microsyringe.

The period of time, which elapsed until the water droplet of dripped distilled water permeated into the water absorptive material (until the glossiness of the water droplet disappeared) after dripping distilled water, was measured. Results are shown in Table 1.

Measurement of Internal Stress of Toner Block

A test piece, which had the size shown in Table 2, was cut out from each of the toner blocks of respective Examples and respective Comparative Examples to measure the internal stress of the toner block.

<1> Measurement of Compressive Stress

Powder Rheometer FT-4 (produced by Freedman Technology) was used as the compressive test machine, and the test piece was pressurized in the thickness direction as shown in FIG. 2A as described above to measure the pressing force obtained when the test piece was collapsed (in a state of being deformed or destroyed). The diameter of the lower surface of the compressing member was 7.7 mm.

The measured pressing force was divided by the areal size of the lower surface of the compressing member to provide the maximum compressive stress of the toner block. Results are shown in Table 2.

<2> Measurement of Shearing Stress

Powder Rheometer FT-4 (produced by Freedman Technology) was used as the compressive test machine, and the test piece was pressurized in the thickness direction while rotating the compressing member as shown in FIG. 2B as described above to measure the shearing force obtained when the test piece was collapsed (in a state of being deformed or destroyed).

In this procedure, the compressing member was moved downwardly so that the helix angle was 30°. The diameter of the lower surface of the compressing member was 47 mm.

The measured shearing force was divided by the areal size of the upper surface of the test piece to provide the maximum shearing stress of the toner block. Results are shown in Table 2.

The maximum shearing stress was divided by the thickness of the test piece to provide the shearing stress per unit thickness of the toner block. Results are shown in Table 2.

Performance Test for Toner Block

<1> Charging of Toner Block

A pressing member and a cutting exfoliation member were installed in a toner accommodating chamber of a development unit (TN580 produced by Brother Industries, Ltd.) provided for a laser printer (HL-5240 produced by Brother Industries, Ltd.) in the same manner as the development unit described above (see FIG. 3) to manufacture a development unit for the test.

The toner block of each of Examples and Comparative Examples was arranged and interposed between the pressing member and the cutting exfoliation member while allowing the pressing member to slide in the development unit for the test.

<2> Printing Fog

Subsequently, the development unit was driven to cut or scrape (shave) the toner block of each of Examples and Comparative Examples to evaluate the printing image quality of the obtained powder of spherical toner particles.

At first, printing paper (4200 20 lb produced by Xerox) was set to the laser printer to print out a white solid image.

The whiteness degree (a1) of the white solid image and the whiteness degree (a0) of unused 4200 printing paper 20 lb (produced by Xerox) were measured by REFLECT METER MODEL TC-6MC (produced by Tokyo Denshoku Co., Ltd.).

The difference in the whiteness degree (a0-a1) is shown as the printing fog in Table 2.

<3> Photosensitive Member Transfer Residue

Subsequently, a solid image was printed, and the laser printer was stopped during the printing.

The development unit (TN580) and the photosensitive member unit provided with the photosensitive member were taken out. A mending tape (produced by Scotch) was stuck only once to the portion of the photosensitive member surface immediately after the completion of the contact with the transfer roller, and the mending tape was separated quickly. Accordingly, the toner (transfer residue toner), which was not transferred to the printing paper, was collected.

The mending tape, to which the transfer residue toner was adhered, was stuck to unused 4200 printing paper 20 lb (produced by Xerox), and the whiteness degree (b1) was measured by using REFLECT METER MODEL TC-6MC (produced by Tokyo Denshoku Co., Ltd.).

A mending tape (produced by Scotch), to which the transfer residue toner was not adhered, was distinctly stuck to unused 4200 printing paper 20 lb (produced by Xerox), and the whiteness degree (b0) was measured in the same manner as described above.

The difference in the whiteness degree (b0-b1) is shown as the photosensitive member transfer residue in Table 2.

In the above description, the spherical toner particles have been explained. However, the present invention is not necessarily limited to the spherical toner particles, but is applicable to toner particles of any shapes.

TABLE 1

| | Name of material | Manufacturer | Mass per unit area ($g/m^2$) | Thickness (mm) | Density ($g/m^3$) | Water absorption degree (cm) | Water absorption amount (g/1 g) | Water absorption speed (0.2 ml distilled water) (sec.) |
|---|---|---|---|---|---|---|---|---|
| A | Filter Paper 2 | Whatman | 103 | 0.19 | 0.542 | 45 | 1.003 | 127 |
| B | Filter paper No. 50 for chromatography | Advantec Toyo | 140 | 0.25 | 0.560 | 6 | 1.331 | 41 |
| C | Filter paper No. 526 for chromatography | Advantec Toyo | 325 | 0.7 | 0.464 | 11 | 3.408 | 2 |
| D | P paper | Fuji Xerox | 64 | — | 0.774 | 0 | 0.491 | <600 |

TABLE 2

| | Water absorptive material | Water amount: Toner suspension (wt %) | Water amount: Aggregate (wt %) | Water absorption time (second) | Size of test piece: Length (mm) | Size of test piece: Width (mm) | Size of test piece: Thickness (mm) |
|---|---|---|---|---|---|---|---|
| Example 1 | A | 32.5 | 32.1 | 25 | 15.3 | 14.7 | 8.3 |
| Example 2 | | 33.3 | 31.9 | 100 | 13.0 | 13.0 | 9.8 |
| Example 3 | | 33.6 | 31.6 | 42 | 15.2 | 12.0 | 7.0 |
| Example 4 | | 33.7 | 32.2 | 38 | 17.0 | 14.2 | 6.5 |
| Example 5 | | 34.9 | 32.3 | 90 | 14.5 | 15.2 | 7.0 |
| Example 6 | | 35.6 | 31.8 | 100 | 16.0 | 15.0 | 7.0 |
| Example 7 | | 35.7 | 30.4 | 70 | 13.5 | 13.8 | 6.3 |
| Example 8 | | 36.5 | 31.3 | 140 | 13.8 | 12.0 | 8.4 |
| Example 9 | B | 33.7 | 31.5 | 55 | 15.0 | 10.8 | 4.0 |
| Example 10 | | 33.9 | 31.9 | 130 | 16.3 | 16.8 | 7.2 |
| Example 11 | | 34.3 | 31.3 | 125 | 15.0 | 16.0 | 9.0 |
| Example 12 | | 34.5 | 32.2 | 70 | 13.5 | 11.3 | 6.0 |
| Example 13 | | 34.9 | 32.2 | 80 | 13.8 | 13.2 | 7.5 |
| Example 14 | C | 33.3 | 31.4 | 15 | 17.4 | 12.2 | 5.0 |
| Example 15 | | 34.3 | 30.1 | 20 | 13.2 | 12.1 | 12.5 |
| Example 16 | | 35.7 | 32.1 | 55 | 14.8 | 16.3 | 7.3 |
| Comp. Ex. 1 | B | 90.0 | 31.0 | — | 12.4 | 18.3 | 8.5 |
| Comp. Ex. 2 | C | 45.9 | 32.2 | 160 | 12.2 | 14.2 | 9.1 |
| Comp. Ex. 3 | B | 37.7 | 32.0 | 155 | 14.5 | 14.5 | 8.2 |
| Comp. Ex. 4 | | 50.0 | 32.0 | 200 | 18.3 | 12.9 | 9.0 |
| Comp. Ex. 5 | A | 41.7 | 31.8 | 170 | 14.7 | 16.9 | 9.7 |
| Comp. Ex. 6 | D | 33.3 | 32.2 | 165 | 16.3 | 14.4 | 9.0 |

| | Physical property of toner block: Bulk density (specific gravity) (g/ml) | Filling rate (%) | Compressive stress ($N/m^2$) | Shearing stress ($N/m^2$) | Shearing stress per unit thickness ($N/m^2$) |
|---|---|---|---|---|---|
| Example 1 | 0.48 | 41.5 | 94293 | 518 | 62410 |
| Example 2 | 0.69 | 60.4 | 96686 | 1055 | 107696 |
| Example 3 | 0.59 | 51.1 | 196594 | 1162 | 166000 |
| Example 4 | 0.48 | 42.1 | 118171 | 300 | 46154 |
| Example 5 | 0.67 | 58.1 | 306601 | 1543 | 220380 |
| Example 6 | 0.70 | 61.1 | 241284 | 1475 | 210714 |
| Example 7 | 0.63 | 54.6 | 305741 | 1279 | 203084 |
| Example 8 | 0.77 | 67.3 | 518932 | 1628 | 193845 |
| Example 9 | 0.59 | 51.0 | 480205 | 685 | 171250 |
| Example 10 | 0.75 | 65.3 | 300799 | 1188 | 165069 |
| Example 11 | 0.75 | 64.8 | 193371 | 1259 | 139835 |
| Example 12 | 0.62 | 54.2 | 107428 | 1111 | 185194 |
| Example 13 | 0.63 | 54.7 | 257828 | 1111 | 148155 |
| Example 14 | 0.45 | 39.1 | 90000 | 128 | 25600 |
| Example 15 | 0.47 | 40.9 | 95000 | 431 | 34480 |
| Example 16 | 0.58 | 50.4 | 189532 | 868 | 119350 |
| Comp. Ex. 1 | 0.82 | 71.3 | 693513 | 2439 | 286941 |
| Comp. Ex. 2 | 0.81 | 70.7 | 700758 | 2230 | 244726 |
| Comp. Ex. 3 | 0.81 | 70.0 | 648068 | 2350 | 286585 |
| Comp. Ex. 4 | 0.87 | 76.0 | 719770 | 2500 | 277778 |
| Comp. Ex. 5 | 0.83 | 72.0 | 700000 | 2400 | 247619 |
| Comp. Ex. 6 | 0.82 | 71.3 | 680400 | 2253 | 249842 |

| | Volume average diameter: Toner suspension (μm) | Volume average diameter: Toner block (μm) | Not less than 20 μm: Toner suspension (volume %) | Not less than 20 μm: Toner block (volume %) | Printing fog | Transfer residue |
|---|---|---|---|---|---|---|
| Example 1 | 8.27 | 8.32 | 0.43 | 0.44 | 0.75 | 2.84 |
| Example 2 | 8.27 | 8.52 | 0.43 | 0.63 | 0.94 | 3.11 |
| Example 3 | 8.27 | 8.54 | 0.43 | 0.69 | 1.18 | 3.64 |
| Example 4 | 8.27 | 8.30 | 0.43 | 0.65 | 0.29 | 2.94 |
| Example 5 | 8.27 | 8.46 | 0.43 | 0.71 | 1.07 | 3.18 |
| Example 6 | 8.27 | 8.29 | 0.43 | 0.40 | 0.94 | 2.31 |
| Example 7 | 8.27 | 8.14 | 0.43 | 0.38 | 0.30 | 3.05 |
| Example 8 | 8.27 | 8.39 | 0.43 | 0.53 | 0.41 | 2.29 |
| Example 9 | 8.27 | 8.27 | 0.43 | 0.46 | 0.22 | 2.37 |
| Example 10 | 8.27 | 8.37 | 0.43 | 0.40 | 1.03 | 3.48 |
| Example 11 | 8.27 | 8.34 | 0.43 | 0.55 | 0.72 | 2.86 |
| Example 12 | 8.27 | 8.29 | 0.43 | 0.58 | 0.48 | 2.68 |
| Example 13 | 8.27 | 8.52 | 0.43 | 0.51 | 0.85 | 2.39 |
| Example 14 | 8.27 | 8.25 | 0.43 | 0.42 | 0.63 | 2.72 |
| Example 15 | 8.27 | 8.32 | 0.43 | 0.70 | 0.49 | 3.05 |
| Example 16 | 8.27 | 8.31 | 0.43 | 0.54 | 0.81 | 2.38 |
| Comp. Ex. 1 | 8.27 | 9.44 | 0.43 | 1.91 | 5.25 | 13.58 |
| Comp. Ex. 2 | 8.27 | 8.87 | 0.43 | 1.40 | 4.89 | 14.84 |

TABLE 2-continued

| | | | | | | |
|---|---|---|---|---|---|---|
| Comp. Ex. 3 | 8.27 | 9.21 | 0.43 | 2.10 | 9.51 | 21.30 |
| Comp. Ex. 4 | 8.27 | 9.38 | 0.43 | 1.88 | 4.80 | 18.33 |
| Comp. Ex. 5 | 8.27 | 9.41 | 0.43 | 3.23 | 7.68 | 16.94 |
| Comp. Ex. 6 | 8.27 | 8.90 | 0.43 | 1.89 | 8.33 | 15.50 |

What is claimed is:

1. A toner block which comprises an aggregate of toner particles in the form of a cake, wherein the toner block has a maximum compressive stress of 80000 to 550000 $N/m^2$ upon collapse; and wherein the toner particles in the toner block immobilize each other so that a shape of the toner block is maintained.

2. The toner block according to claim 1, wherein the toner block has a maximum shearing stress of 120 to 1800 $N/m^2$ upon collapse.

3. The toner block according to claim 1, wherein the toner block has a bulk density of 0.3 to 0.8 g/ml.

4. The toner block according to claim 1, wherein the toner block has a filling rate of 30 to 69%.

5. The toner block according to claim 3, wherein the toner block is obtained by:

preparing a toner suspension in which the toner particles are dispersed in water so that a water amount is 32.5 to 37% by mass;

absorbing water contained in the toner suspension by a water absorptive material which absorbs 0.2 ml of water within 3 minutes to prepare an aggregate of the toner particles containing water of not more than 32.3% by mass; and drying the aggregate.

6. The toner block according to claim 1, wherein the toner block has a maximum compressive stress of 90000 to 500000 $N/m^2$ upon collapse.

7. The toner block according to claim 2, wherein the toner block has a maximum shearing stress of 150 to 1650 $N/m^2$ upon collapse.

8. The toner block according to claim 3, wherein the toner block has a bulk density of 0.45 to 0.7 g/ml.

9. The toner block according to claim 4, wherein the toner block has a filling rate of 39 to 65%.

* * * * *